United States Patent [19]

Jehle et al.

[11] Patent Number: 4,658,741

[45] Date of Patent: Apr. 21, 1987

[54] METHOD AND APPARATUS FOR DETERMINING THE AMOUNT OF ADVANCE OF A PLURALITY OF MATERIAL PLIES

[75] Inventors: Fritz Jehle, Enkenbach-Alsenhorn; Erich Willenbacher, Kaiserslautern; Oskar Braun; Dietmar Becker, both of Kaiserslautern, all of Fed. Rep. of Germany

[73] Assignee: Pfaff Industriemaschinen GmbH, Fed. Rep. of Germany

[21] Appl. No.: 884,402

[22] Filed: Jul. 11, 1986

[30] Foreign Application Priority Data

Jul. 13, 1985 [DE] Fed. Rep. of Germany ..... 3525028

[51] Int. Cl.[4] ..... D05B 97/00; D05B 35/00; D05B 27/22

[52] U.S. Cl. ..... 112/262.1; 112/131; 112/220; 112/272; 112/314

[58] Field of Search ..... 112/262.1, 131, 121.26, 112/121.25, 272, 220, 314, 315

[56] References Cited

U.S. PATENT DOCUMENTS

| | | | |
|---|---|---|---|
| 2,368,539 | 1/1945 | Gluckman | 112/121.25 |
| 3,954,071 | 5/1976 | Mall et al. | 112/314 X |
| 4,036,156 | 7/1977 | Becker et al. | 112/121.26 |
| 4,037,546 | 7/1977 | Kleinschmidt | 112/121.26 |
| 4,102,280 | 7/1978 | Hannemann | 112/121.26 |
| 4,404,919 | 9/1983 | Martell et al. | 112/272 X |
| 4,495,877 | 1/1985 | Willenbacher | 112/272 X |
| 4,545,310 | 10/1985 | Treadwell et al. | 112/272 X |

FOREIGN PATENT DOCUMENTS

| | | |
|---|---|---|
| 1302988 | 2/1971 | Fed. Rep. of Germany . |
| 3216993 | 11/1983 | Fed. Rep. of Germany . |

*Primary Examiner*—H. Hampton Hunter
*Attorney, Agent, or Firm*—McGlew and Tuttle

[57] ABSTRACT

Method and apparatus for determining and regulating the amount of advance of a plurality of workpiece plies at a sewing machine which is affected by scanning the individual plies while recording the stitches being formed between two separate feed points and actuating top and bottom feed devices to achieve a desirable feed of each ply. Signs present or to be applied at any desired point of the workpiece plies are scanned at two successive points, and pulses generated by a pulse generator connected with the main shaft of the machine are summed during this period of time. The pulse sum is compared with a number of pulses which depends on the mutual spacing of the scanning points and on the adjusted stitch length. For two work plies the pulse sums formed between the recognition of the signs are compared directly. As signs to be scanned are used either imprinted marks, the jags of a pinked workpiece edge, or the bright, dark structure of a surface section of the workpiece.

19 Claims, 8 Drawing Figures

157
158
173
81
156
155
151
150
146
149
148
145
141
147
140
142
172
171
169
168
164
167
166
165
163
W3
131
162
W4
159
160
161
129
130
170
A2
Q
S
R
K
Z
N
V
1
2
3
4
5
6
9
10
40
41
43
45
46
47
48
56
57
58
91
92
152
153
154

METHOD AND APPARATUS FOR DETERMINING THE AMOUNT OF ADVANCE OF A PLURALITY OF MATERIAL PLIES

FIELD AND BACKGROUND OF THE INVENTION

This invention relates in general to sewing machines and in particular to a new and useful method and apparatus for determining and adjusting the amount of advance of a plurality of plies of workpieces fôr the purpose of coordinating them.

For the performance of various switching and control processes in the automation of certain sewing jobs, as for instance in the sewing together of two work plies with exact end edges of precise length, it is advantageous to determine exactly the actual amount of advance of the work per forward step of the feeder or a possible relative motion between two plies.

Through German Pat. No. 32 16 993, a method for chine for the sewing together of two plies in proper position is known where for each ply a measuring wheel scanning their amount of advance is provided, which wheel delivers pulses for a control circuit acting on the feeders. It has been found that between the plies and the measuring wheels a slip may occur which falsifies the measurement result and which depends, inter alia, on the cloth type of the workpiece, the direction of the warp and weft threads and the rate of feed. For this reason this measuring method is imprecise, in particular for relatively long seams.

Through German OS No. 32 16 993, a method for measuring the amount of advance of a workpiece in the end section of a seam is known, where the work follow-up edge, extending at an angle to the edge being worked, is scanned by a sensor device which comprises essentially two sensors arranged spaced one behind the other. The sum of the pulses, formed in the interval between the response of the two sensors, of a pulse generator connected with the main shaft of the sewing machine; is compared with a number of pulses which is calculated by a microprocessor as a function of the distance between the scanning points of the two sensors and as a function of the set stitch length of the feeder of the sewing machine. From the difference of the pulse sums, if one exists, the size of the slip between feeder and workpiece is determined.

As the beginning and end of the pulse counting process are triggered by the scanning of a workpiece edge, the workedges must be well trimmed and must not be fringed if great precision is to be achieved. Since here always the followup edge of the workpiece extending at an angle to the edge being worked is being scanned, this measuring method can be carried out only in the end section of a seam, for example for exact approach of the seam corner.

Lastly through German Pat. No. 1,302,988 a control is known where various switching means of a sewing machine are controlled by the scanning of reflecting marking points applied on a template lying on the workpiece itself, Here it is necessary, if a high work related switching accuracy is to be obtained, that the marking points are exactly correlated with those points of each workpiece at which certain switching processes are to be triggered. This prerequisite is indeed fulfilled with the use of templates bearing marking points, provided the template and the workpiece are always exactly aligned; but the expense of producing such templates is warranted only for a large number of identical workpieces. Even if the marking points are applied directly on each single workpiece, to make sure of the stipulated accuracy of placement a template will again be used, so that this type of marking is meaningful only for a large number of identical workpieces also.

SUMMARY OF THE INVENTION

The invention provides a method for measuring the amount of advance of workpieces on a sewing machine which can be carried out with sufficient precision at any desired point of a seam and is suitable also for single workpieces of different form and size.

By the measure of scanning workpiece bound signs situated at any desired point of the work ply and either existing anyway or to be applied, one can achieve at any time of the seam formation a feed synchronous slip free measured value formation which permits a very precise determination of the actual amount of advance in a manner which is repeatable any number of times.

According to an embodiment of the invention when two plies are sewn together, the amount of advance is determined for each work ply. When using sewing machines with top and bottom transport, this makes it possible to measure exactly a possibly existing relative motion between the two plies and to eliminate it. As the advance can be measured at any desired point of a seam, it is further possible, for example, in the case of extra width sections to be provided within the seam on one of the two plies, for instance in the hip region of trousers, to control exactly the beginning and end of the extra width section. Moreover, at the same time the extra width amount can be measured exactly and corrected if desired.

The signs to be scanned can be formed by marks to be applied on the workpiece before or during the sewing, and the signs to be scanned may be formed by a plurality of marks constituting a scale. If these marks are applied during or after the cutting to pattern with the position of the workpiece undistorted, and if the marks have everywhere the same mutual distance, it is possible with the scanning of these marks to measure not only the actual amount of advance but also a possibly occurring elongation or distortion of the workpiece and to take this into account in the subsequent treatment.

This advantage is achieved also with the mark being formed by a pinked edge of the work ply. If the pinking does not require a separate operation, but can take place simultaneously with the cutting to pattern or during a preceding sewing process, the need to apply separate marks is eliminated.

If after the marking or after passage through the first scanning point the work ply undergoes during the further advance, a rotation about the axis of the needle, it is achieved by making a mark which is arched wider than the second scanning point that the section of the arched mark passing through the second scanning point will always have traveled exactly a path corresponding to the mutual distance of the scanning points. Thus an exact advance determination can still be carried out even at a varying angular alignment position of a workpiece.

A method for the scanning of an unprepared workpiece also is indicated here. The signs to be scanned are for example extended sections of a color pattern, where, however, the repeat, i.e. the pattern width in the feed direction, must be greater than the mutual distance of the scanning points of the sensor device. This limitation is overcome, if, instead of a recurring pattern, the brightness structure resulting from the position and from the spacing of warp and weft threads and possibly a color pattern under an illumination possibly casting a shadow is observed, which brightness structure, like a fingerprint, is unique and does not repeat at any point of the workpiece.

In the inventive device, the scanning and marking device circuit connected with the signal processing system also fulfills the function of the front scanning point, in that it, too, starts the pulse counting process.

In order that the marks will not impair the appearance of the finished workpiece, the marking substance should be visible only temporarily or not at all. Suitable for this purpose are optically readable volatile or fluorescent inks, inductively or capacitively recognizable iron powder, or high or low-temperature marks scannable by thermo-sensors.

An advantageous variant of the device by which automatic performance of a plurality of marking processes uniformly distributed over the entire seam is made possible by use of a strobe disc associated with the pulse generator.

For the scanning of signs already existing on the work plies, the sensor device comprises for each ply two scanning points arranged spaced one behind the other, or respectively two sensors are used.

By one measure of the inventions it is achieved that, in case there are, between the scanning points, always several signs to be scanned, such as pinking, always only that sign ends the pulse counting process which had previously started the pulse counting process.

The inventive device also permits an analog electronic measured value formation of the bright dark contrast of the scanned work surface section and the subsequent transformation of analog signal values into binary signal values, owing to which the signal values obtained at the front scanning point can be compared for coincidence more easily and more accurately with those of the rear scanning point.

Other measures of the invention make possible a sufficiently exact scanning of a certain work surface section by two line scan cameras arranged spaced one behind the other even if the scanned ply has moved laterally during the forward movement.

Another measure of the invention makes possible the simultaneous evaluation of the several signal value rows, whereby the evaluation time for a single take of the rear line scan camera is considerably shortened. In this manner one can achieve a higher picture repetition frequency (or frame rate) and by the resulting greater number of individual measured values per unit area, a greater measurement precision.

Accordingly it is an object of the invention to provide an improved method and device for determining and adjusting the amount of advance of a sewing machine.

A further object of the invention is to provide a method and apparatus for determining and regulating the amount of advance of a plurality of workpiece plies at a sewing machine which is effected by scanning the individual plies while recording the stitches being formed between two separate feed points and actuating top and bottom feed devices to achieve a desirable feed of each ply.

A further object of the invention is to provide a device for applying a sign to workpiece portions during the feed thereof in a sewing machine for the purpose of scanning the stitches which are formed between the sign and a succeeding point.

A further object of the invention is to provide an apparatus for effectively feeding a workpiece to a thread needle which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Embodiment Example 1

Figure 1:
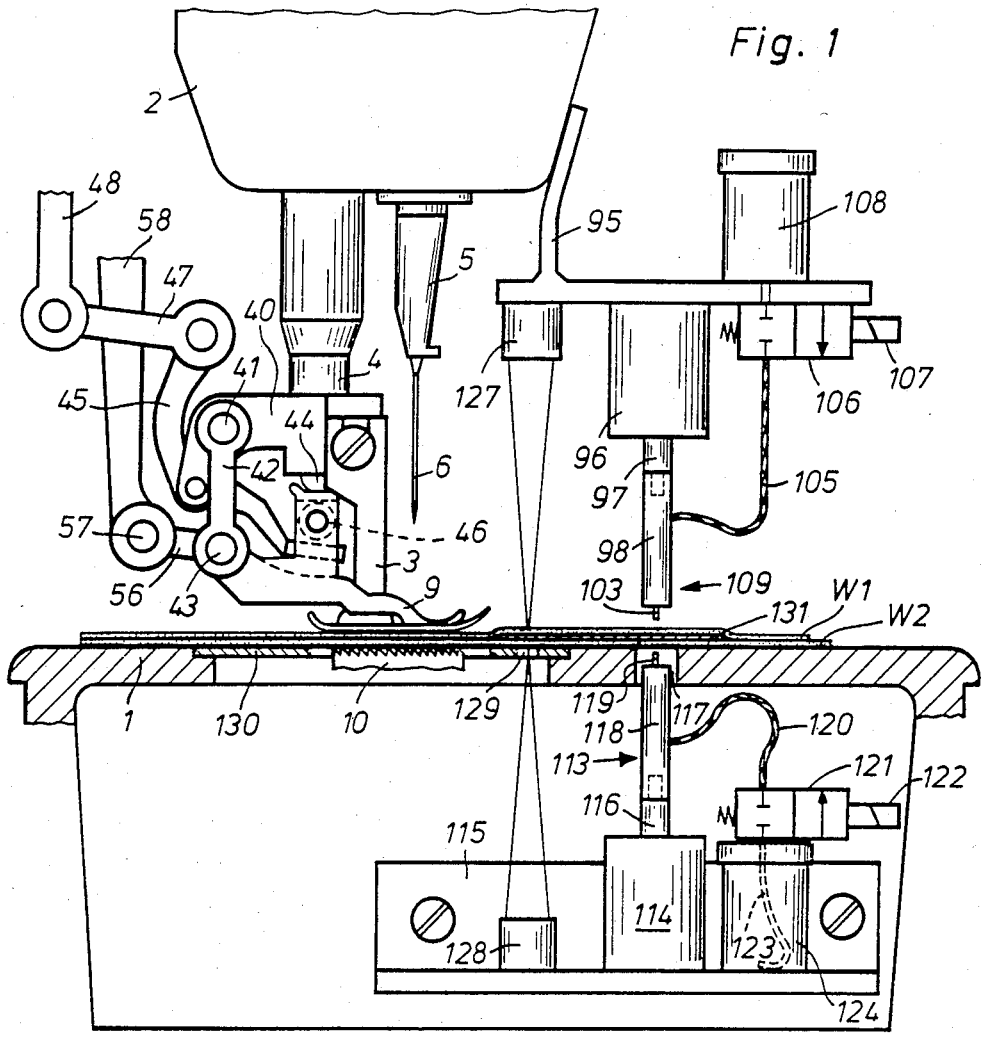
FIG. 1 is a side view of the sewing machine with two scanning and marking devices and sensors.

Referring to the drawings in particular, the invention embodied therein comprises a sewing machine which has a thread needle 6 reciprocating and swinging on one first side of a support surface of a base plate 1 onto which multiple plies of material W1 and W2 are fed and which is adapted to cooperate with a bobbin (not shown) arranged on an opposite second side, to form stitches in the materials. In accordance with the invention, the sewing machine includes a first feed mechanism 9 engageable with materials on the first side to advance them in the feed direction indicated by the arrow V in FIGS. 4 and 7. The second feed mechanism 10 is engageable with the materials on the opposite second side to advance them also in the feed direction at rates which are to be controlled so as to effect a proper stitching. For the purpose of carrying out the invention, feed drive means 55 are connected to thread needle 6 to drive it and the first feed mechanism 9 and the second feed mechanism 10 which are hereinafter referred to as upper and lower feed drives. The drive includes a stitch setting means for setting both swing and the reciprocation drive of the needle. Drive regulation means are provided for regulating the drive of the first drive and the second drive and these will be described more fully in respect to the setting device 81. The invention also includes a sensor device or signal processor 112 for scanning materials at least two separate spaced apart scanning locations extending along the feed direction V. The construction also includes pulse generating means 92 to be described more fully hereinafter which are associated with the feed drive for generating a pulse signal in response to and in proportion to the speed of the drive means and which are connected to the sensor device. The pulse generating means are actuated at the scanning locations to evaluate the pulses generated between the scanning locations. The signal processing device 112 provides a comparison between the desired pulse number corresponding to the stitch length and the actual distance between the two scanning locations.

FIG. 1 shows the side view of a part of a sewing machine which comprises in known manner the base plate 1 and a head 2. Received in the head 2 of the sewing machine is a presser bar 4, carrying a conventional presser foot 3, and also a needle bar 5, the thread carrying needle 6 of which cooperate bobbin or shuttle (not shown). For advancing two workplies W1 and W2 to be connected together, the sewing machine has the upper feeder 9 and the lower feeder 10.

The lower feeder 10 (FIG. 3) is received by a support 11 arranged below the base plate 1, the forked end of said support embracing an eccentric 12 which is disposed on a shaft 13 mounted in the base plate 1 and imparts one stroke motion per stitch forming process to the feeder 10. The other end of support 11 is connected to a forked pitman 14, which is secured on a shaft 15 also mounted in the base plate 1. For the drive of shaft 15 there is fastened on a shaft 16, which is parallel to shaft 13 and in drive connection therewith, an eccentric 17 whose eccentric rod 18 is articulated to a journal 19. Mounted on journal 19 is a pitman 20 which by means of a journal 21 is connected to a crank 22 secured on the shaft 15. Laterally of the eccentric rod 18, on journal 19, a pitman 23 is fastened which embraces a journal 25 carried by a crank 24. The effective length of pitman 23 equals the effective length of pitman 20, so that, when the two journals 21 and 25 are aligned, shaft 15 remains at rest despite the movement of the eccentric rod 18.

For varying the movements of eccentric rod 18 when it becomes active on shaft 15, crank 24 is clamped onto a setting shaft 26 mounted in base plate 1, and carrying in addition a setting crank 27. Via an intermediate element 28 and another setting crank 29, the setting crank 27 is connected to an intermediate shaft 30 mounted in the base plate; on its free end a crank 31 is clamped. The latter is connected via a ball end tie rod 32 with one end of a rocking lever 33 which is pivotable about an axle 34 fixed to the housing. The other end of the rocking lever 33 has a spherical projection 35 and protrudes into a setting cam 36 of a mutually rotatable and fixable adjusting wheel 37 arranged on an axle 38 fixed to the housing. The setting cam 36 in the adjusting wheel 37 spirals around the axle 38 in such a way that the stitch length can be adjusted for example between 1 and 6 mm at the lower feeder 10. A spring 39 which surrounds the intermediate shaft 30 and is fastened at one end to the base plate 1 keeps the projection 35 of the rocking lever 33 in constant abutment on one of the sidewalls of the setting cam 36.

Figure 3:
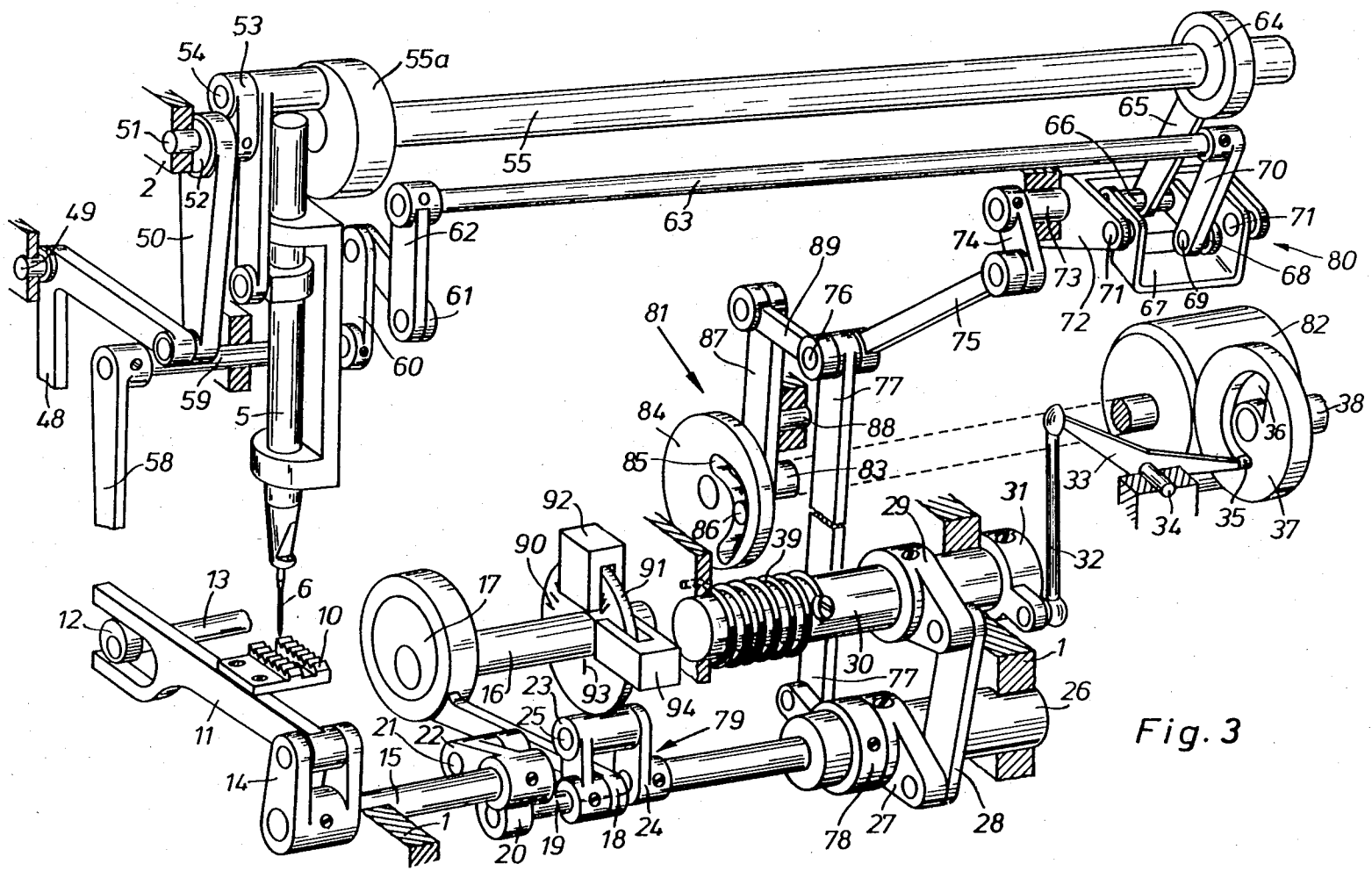
FIG. 3 is a perspective view of the drive and of the stitch units for the feed tools of the sewing machine.

At its lower end the presser bar 4 (FIG. 1) is provided with a cross-piece 40 which carries a journal 41. Mounted on journal 41 is a pitman 42 which is articulatedly connected to the upper feeder 9 by means of a journal 43. This feeder is continuously pressed downward by a spring loaded ball 44 and receives its stroke movement from a lever 45 which is pivotably mounted at the cross-piece 40 and whose free end engages from below a roller 46 carried by two lateral bearing pieces of the upper feeder 9. The lower end of lever 45 is connected via an intermediate element 47 with an angle lever 48 which is pivotably mounted on a journal 49 fixed to the housing (FIG. 3). The angle lever 48 is articulated to an eccentric rod 50, which embraces an eccentric 52 rotatably mounted in head 2 on a journal 51. This eccentric receives its drive from a crank 55*a* formed in one piece with the upper main shaft 55. As already a comparatively small rocking movement of the angle lever 48 suffices to lift the upper feeder 9, the point of articulation of crank 53 and eccentric 52 lies on a prolongation of the upper main shaft 55 of the sewing machine.

For the drive of the upper feeder 9, there engages at journal 43 (FIG. 1) and intermediate pitman 56 which by means of a journal 57 is connected with a rocking lever 58 which in turn is secured on a rocking shaft 59 (FIG. 3) mounted in head 2 of the sewing machine. The rocking shaft 59 receives its drive from a crank 60 secured on it, which is connected via a pitman 61 to a crank arm 62 of an upper rocking shaft 63. The upper rocking shaft 63 is driven directly by an eccentric 64 which is arranged on the upper main shaft 55 and whose eccentric rod 65 embraces a journal 66 which is carried by two lateral pieces of a stirrup 67. At journal 66 there engages further a pitman 68 which by means of a journal 69 is articulated to a crank 70 carried by the upper rocking shaft 63. By means of two mutually aligned bearing pins 71, the stirrup 67 is pivotably mounted on a yoke-shaped setting element 72 which is provided with an axle end 73 and is pivotably mounted in the housing of the sewing machine. When the setting element 72 is pivoted about its axle end 73, the relative position between the bearing pins 71 and the journal 69 changes and hence also the magnitude of the rocking movement of crank 70 changes.

To pivot the setting element 72, there is fastened on its axle end 73 a crank 74 which by way of a pitman 75 and a journal 76 engages at the upper end of a connecting rod 77. The lower end of connecting rod 77 is articulated to a setting crank 78, which in turn is fixed on the setting shaft 26. It is achieved by this arrangement that as the adjusting wheel 37 is displaced, the feed adjustment of the lower feeder 10 can be varied synchronously with the feed adjustment of the upper feeder 9. The components 20 to 26 here form a stitch setting unit 79, and the components 67 to 73 a stitch setting unit 80.

To be able to change the amount of feed of the upper feeder 9 relative to the amount of feed of the lower feeder 10 to obtain equal advances of the two work plies W1 and W2, a setting device 81 is provided which comprises a step motor 82 and a control disk 84 disposed on the drive shaft 83. The control disk 84 has machined in it a circulinear groove 85, into which a pin 86 engages. The pin 86 is received by a rocking lever 87 which is pivotable about an axle 88 fixed to the housing and is articulatedly connected at its upper end to an intermediate element 89. The other end of the intermediate element 89 engages at the journal 76 connecting the connecting rod 77 with pitman 75 and thus offers the possibility of varying the angular position of the two pitmans 74 and 75 forming a hinge joint, when the adjusting wheel 37 is engaged, to change the amount of feed of the upper feeder.

Shaft 16 carries a strobe disc 91 provided with a plurality of bar marks 90 and cooperating with a pulse generator 92. The bar marks 90 exist on a part of the strobe disk 91 only, namely on the part which is scanned by the pulse generator 92 during the transport phase of the feeder 9 and 10. In this manner the pulse generator delivers pulses only during the transport phase of the sewing machine. The strobe disk 91 further contains a bar mark 93 which has a smaller radial distance from the axis of rotation of disk 91 and therefore does not influence the pulse generator 92. Bar mark 93 cooperates with a pulse generator 94. The bar mark 93 lies on that part of a strobe disk 91 which passes through pulse generator 94 during the non-transport phase of the feeders 9 and 10.

Figure 2:
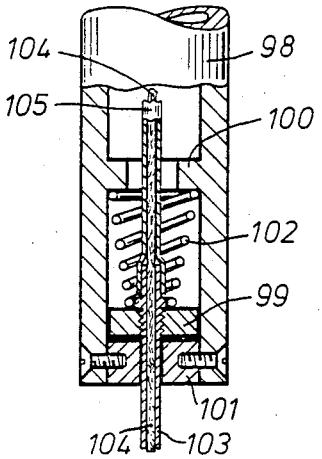
FIG. 2 is an enlarged sectional view of the plunger of a scanning and marking device.

At a support 95 disposed on head 2 an electromagnet 96 is secured, whose tie rod 97 is held by a spring (not shown) in the raised position shown in FIG. 1. Screwed onto the end of tie rod 97 is a guide tube 98 in which a piston 99 see FIG. 2) is displaceable. Piston 99 is secured on one side by an annular stop 100 and on the other side it is axially secured by an insert 101 and held in abutment on inserted 101 by a compression spring 102. In piston 99 a tubular plunger 103 is secured, the interior of which is filled with wick material 104. Placed on the upper end of plunger 103 is a thin hose 105 which is filled with the same wick material 104.

The hose 105 is passed through a bore, contained in the guide tube 98, and is connected with a 2/2-way valve 106. Valve 106 is held in the closing position shown in FIG. 1 by spring force and is switchable to the flow position by a built-in switching magnet 107. Valve 106 is further connected to the discharge opening of a container 108 attached on support 95. Container 108 contains dark colored volatile ink which after application on a work ply is visible only ephemerally.

The electromagnet 96 and switching magnet 107 of the distributing valve 106 are connected via corresponding amplifiers (not shown) and two lines 110 and 111 (FIG. 4) to one output each of a signal processing system 112 with microprocessor. Components 96 to 108 form a combined scanning and marking device 109.

Below the base plate 1 a second combined scanning and marking device is arranged, which is designated by 113. The scanning and marking device 113 is composed of the same components as the scanning and marking device 109. Hence it comprises an electromagnet 114, fastened on a support 115. The tie rod 116 of electromagnet 114 is held in the lowered position shown in FIG. 1 by a spring (not shown). Screwed onto the end of tie rod 116 is a guide tube 118 protruding into a bore 117 in base plate 1 and carrying a displaceable spring-loaded tubular plunger 119. Placed on the lower end of plunger 119 is a thin hose 120. Hose 120 is brought out of the guide tube 118 and connected with a 2/2-way valve 121. Valve 121 is held in the closing position shown in FIG. 1 by spring force and is switchable to flow position by a built-in switching magnet 122. From valve 121 a thin hose 123 leads into a container 124 secured on support 115 below valve 121. The plunger 119 and the two hoses 120 and 123 are filled with a wick material (not shown). Like container 108, container 124 is filled with dark-colored volatile ink.

The electromagnet 114 and switching magnet 122 of the distributing valve 121 are connected via corresponding amplifiers (not shown) and two lines 125 and 126 to one output each of the signal processing system 112.

On each of the two supports 95, 115 a sensor 127, 128 is fastened, the lower sensor 128 being arranged below a bore 129 of the stitch plate 130 (FIGS. 1 and 5) inserted in the base plate 1. The sensors 127 and 128 consist of a light emitter and a light receiver and serve to scan two work plies W1, W2, which are separated from each other by an intermediate plate 131 disposed on base plate 1. Each of the sensors 127, 128 is connected via lines 132,133 with an input of the signal processing system 112. A mutual distance A1 exists in feed direction V between the contact point of the plungers 103, 119 on the work plies W1, W2, on the one hand, and the scanning point of the sensors 127, 128, on the other.

The signal processing system 112 has a data input device 134 with keyboard (FIG. 4) and is connected via input lines 135,136 to the two pulse generators 92, 94 and via an output line 137 and a control circuit (not shown) to the step motor 82 of the setting device 81.

EMBODIMENT EXAMPLE 2

The setup of the sewing machine is identical with that for the first embodiment example. Here, however, only the pulse generator 92 is needed.

Figures 5, 6:
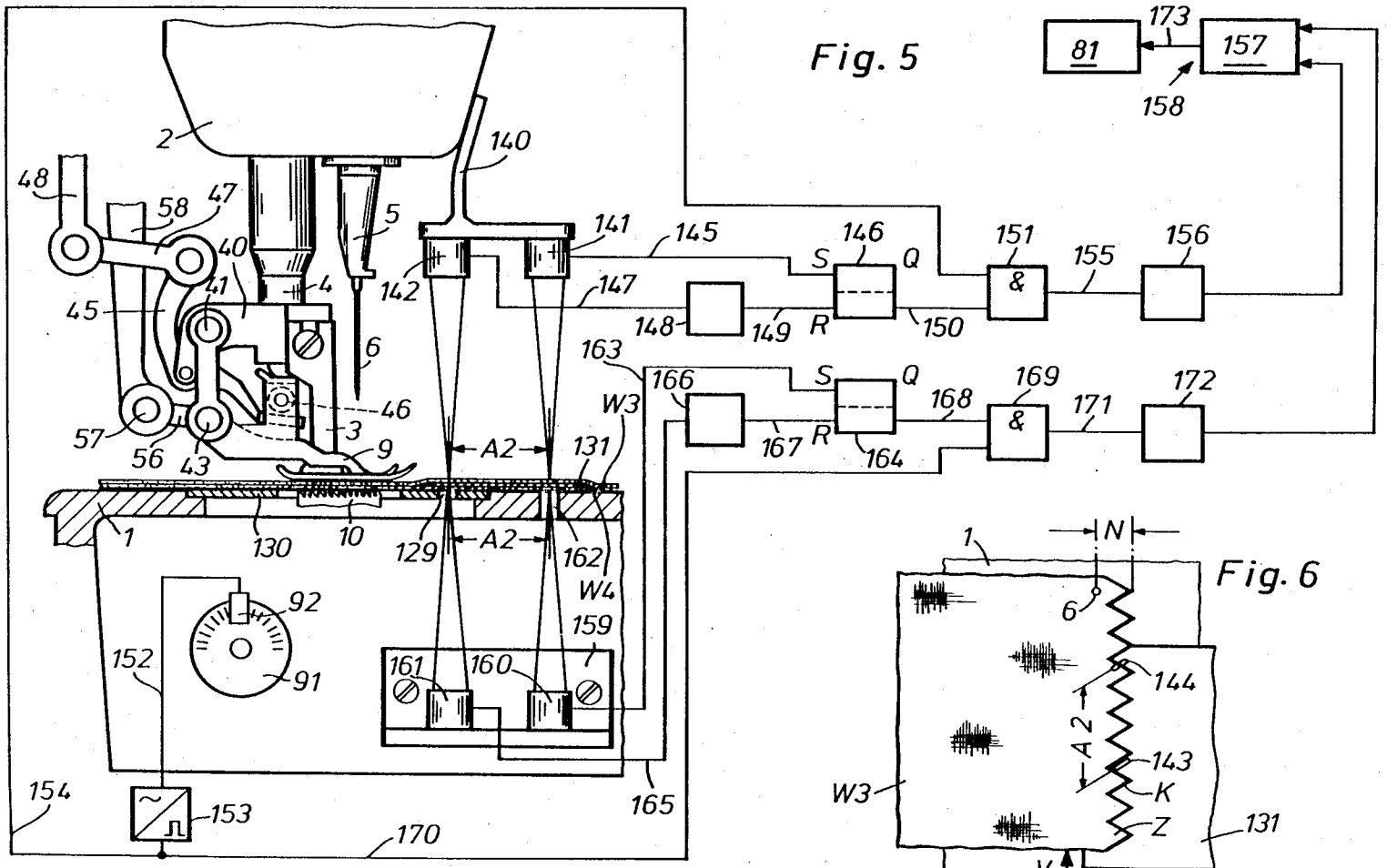
FIG. 5 is a side view of the sewing machine with the second embodiment and a block diagram of the signal processing system.
FIG. 6 is a top view of a work ply with pinked edge and the position of the scanning points of two sensors.

Secured on a support 140 arranged on head 2 are two sensors 141,142 which consist of a light emitter and a light receiver. The light emitters contain a lens system (not shown) and a slit mask. whereby the emitted light rays produce at the point of incidence, i.e. on the upper work ply W3 or on the intermediate plate 131 a linear light bar 143, 144, respectively (FIG. 6). The sensors 141, 142 or their slit masks are oriented so that the longitudinal axes of the light bars 143, 144 run parallel to the edges K of the pinked edging Z of the upper work ply W3. The surface of the intermediate plate 131 is polished, owing to which the light rays emitted by the light emitters are reflected to the respective light receivers as they impinge on the intermediate plate 131. The light bars 143, 144 produced on the intermediate plate 131 having a spacing therebetween A 2. For adaptation to different seam distances N the sensors 141, 142 are adjustable crosswise to the feed direction shown by arrow V.

The front sensor 141 is connected via a line 145 to the setting input of an edge-controlled flip-flop 146. The rear sensor 142 is connected via a line 147 to a preselection counter 148 whose output is connected via line 149 to the reset input of flip-flop 146. The output of flip-flop 146 is connected via a line 150 to an input of an AND gate 151. The pulses generated by the pulse generator 92 are supplied via a line 152 to a pulse former 153 and thence via a line 154 to a second input of the AND gate 151. The output of the AND gate 151 is connected via a line 155 to a register 156, which together with a microprocessor 154 is a component of a signal processing system 158.

On a support 159 secured below the base plate 1, two sensors 160 and 161 are arranged, which are designed and arranged in the same manner as the sensors 141, 142 and operate like them. The base plate 1 has a bore 162 for passage of the light rays of sensor 160. The light rays of sensor 161 pass through the bore 129 of the stitch plate 130.

The front sensor 160 is connected via a line 163 to the setting input of an edge-controlled flipflop 164. The rear sensor 161 is connected via a line 165 to a preselection counter 166, whose output is connected via a line 167 to the reset input of flip-flop 164. The output of flip-flop 164 is connected via a line 168 to one input of an AND gate 169. To a second input of the AND gate 169 are supplied via a line 170 the pulses generated by pulse generator 92 and transformed in the pulse former 153. The output of the AND gate 169 is connected via a line 171 to a register 172, which is a component of the signal processing system 158. An output of the signal processing system 158 is connected via a line 173 to the setting device 81.

EMBODIMENT EXAMPLE 3

Figure 7:
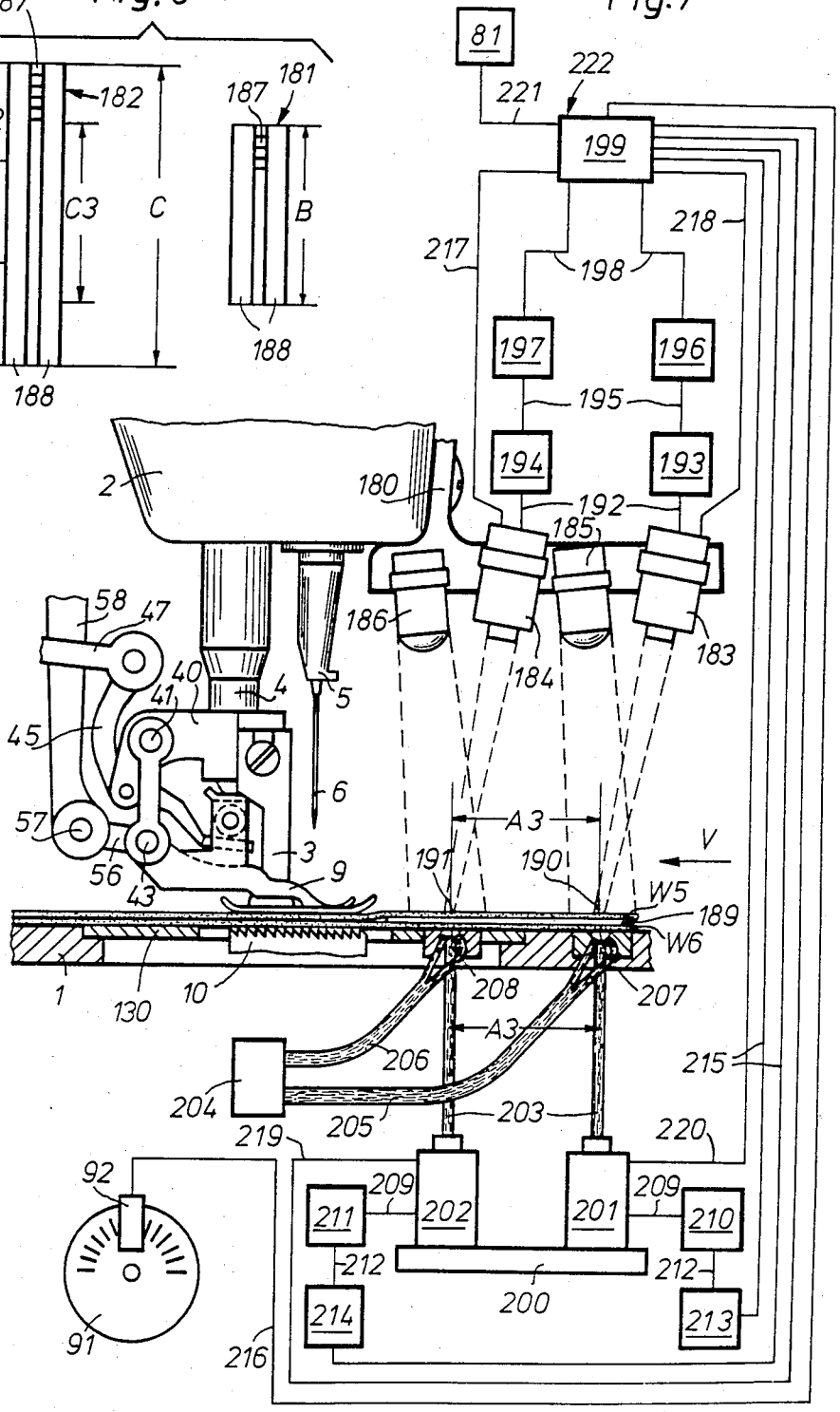
FIG. 7 is a side view of the sewing machine with the third embodiment and a block diagram of the signal processing system.

The setup of the sewing machine is identical with that for the first embodiment example. Here, however, only the pulse generator 92 is needed. (FIG. 7). At a support 180 disposed on head 2 there are fastened as sensor device for the upper work ply W5 two line scan cameras 183 and 184 each equipped with a CCD image sensor (charge-coupled devices) (FIG. 8) and two light sources 185,186. The CCD image sensors 181, 182 comprise a plurality of square photo-elements 187 strung up in a row, each having an edge length of 13 μm and connected with two parallelly arranged analog shift registers 188.

Figure 8:
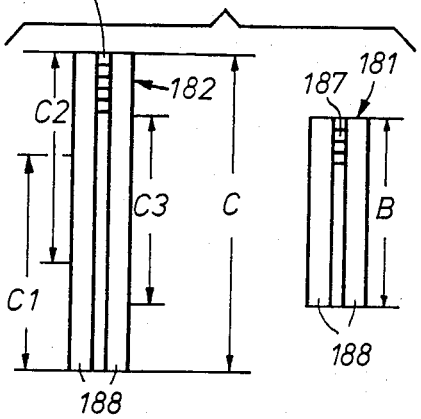
FIG. 8 is a schematic representation of the CCD image sensor of a front and of a rear line scan camera.

The CCD image sensor 181 of the front line scan camera 183 contains 1024 photo-elements 187 and hence has a scan line length of about 13.3 mm, indicated in FIG. 8 by B. The CCD image sensor 182 of the rear line camera 184 contains 1728 photo-elements 187 and hence has a scan line length of about 22.5 mm, marked C in FIG. 8. The line scan camera 183 and the light source 185 together form on the upper workpiece W5 of an intermediate plate 189 to a front scanning point 190 running crosswise to the feed direction V and having the width B, while the line scan camera 184 and light source 186 form a rear scanning point 191 of width C, which runs parallel to the front scanning point. The two scanning points 190, 191 have a mutual spacing A3

Each line scan camera 183, 184 is connected via a line 192 for each to a comparator 193,194, which transforms the analog video signals of the respective line scan camera 183, 184 into binary video signals. The comparators 193 and 194 are each connected via a line 195 to a shift register 196, 197, and these are connected via a line 198 to a microprocessor 199.

On a support 200 secured below the base plate 1, two line scan cameras 201 and 202 are arranged, which are constructed like the line scan cameras 183, 184, i.e. the CCD image sensor of the front camera 201 has the line length B, while the CCD image sensor of the rear camera 202 has the line length C. Each of the cameras 201, 202 is connected with one end of a light guide 203 consisting of a plurality of optical fibers. Further a light source 204 is provided, to each of which one end of two light guides 205, 206 consisting of a plurality of optical fibers is connected. The light guides 203, 205, 206 are secured in a manner not explained more explicity in passage bores of the base plate 1 and of the stitch plate 130. The line scan camera 201 and its light guide 203 form with the light source 204 and light guide 205 a front scanning point 207 of the width B. In the same manner the line scan camera 202 and its light guide 203 form with the light source 204 and light guide 206 a rear scanning point 208 of the width C. The two scanning points 207, 208 have the same mutual distance A3 as the scanning points 190, 191.

Each line scan camera 201, 202 is connected via a line 209 for each with a comparator 210, 211, which transforms the analog video signals of the respective camera 201, 202 into binary video signals. The comparators 210, 211 are connected via a line 212 for each to a shift register 213, 214 for each, and these are connected via a line 215 to the microprocessor 199.

An input of microprocessor 199 is connected via a line 216 to the pulse generator 92. Four outputs of microprocessor 199 are connected via a line 217, 218, 219,220 to the line scan cameras 183, 184, 201, 202. Another output of microprocessor 199 connects via a line 221 with the setting device 81.

The comparators 193, 194, 210, 211, the shift registers 196, 197, 213, 214 and the microprocessor 199 form a signal processing system 222.

Mode of Operation

Embodiment Example 1

At the beginning of a sewing process, the control disk 84 of the setting device 81 is in central position, i.e. the two ends of the groove 85 are equidistant from the pin 86. The result of this is that the stitch setting unit 80 is adjusted to the same amount of advance as the stitch setting unit 79 and that consequently the two feeders 9, 10 execute feed steps of equal size.

Figure 4:
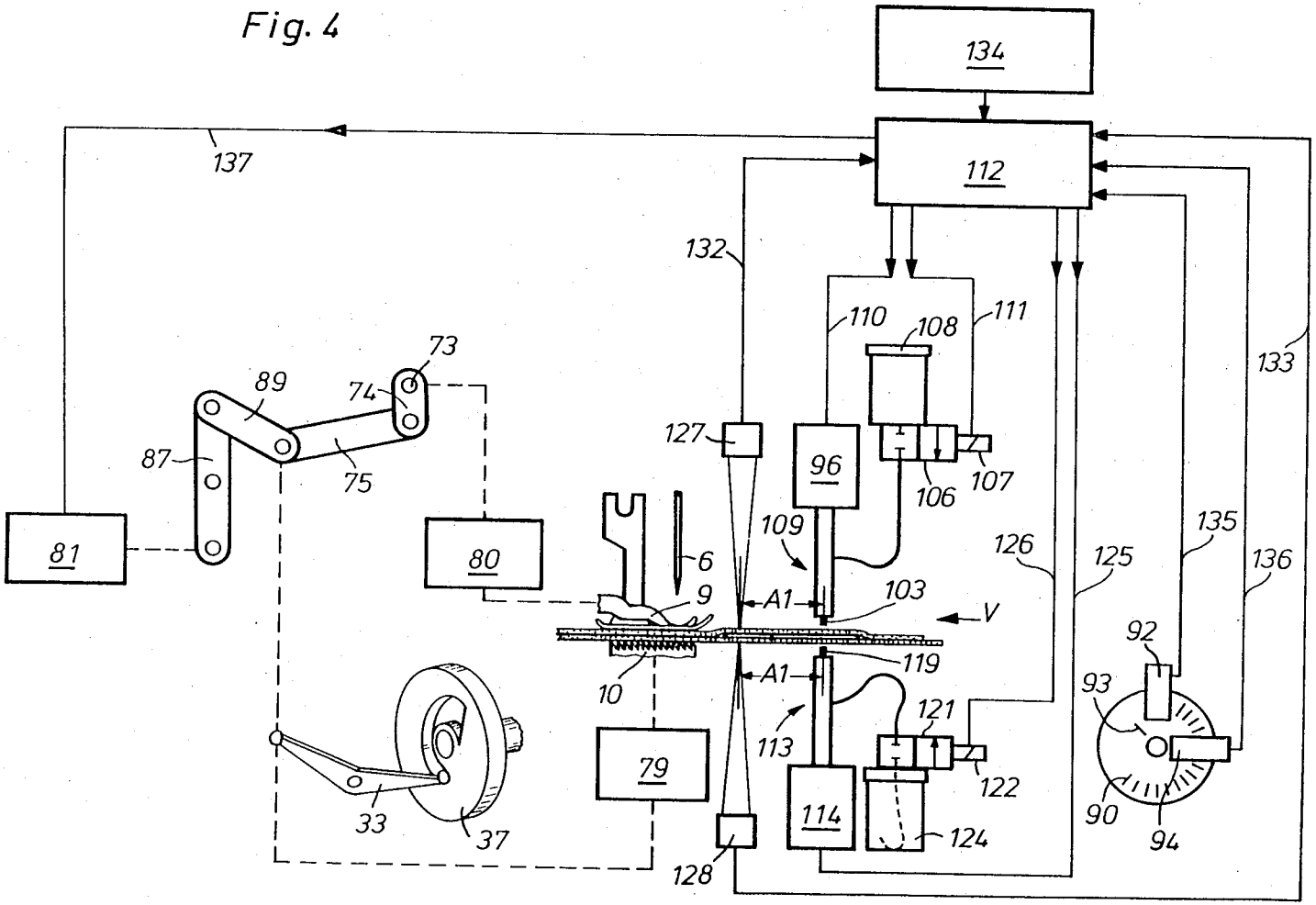
FIG. 4 is a block diagram of the signal processing system.

With each full revolution of the strobe disk 91, i.e. with each stitch forming process, the pulse generator 94 generates upon passage of the bar mark 93 a pulse, which is passed on to the signal processing system 112 (FIG. 4). The system 112 is programmed so, as a function of the stitch length adjusted at wheel 37, that for a feed path composed of several feed steps, which corresponds to the distance A1, output signals for the scanning and marking device 109, 113 are triggered only once during a non-transport phase of the feeders 9 and 10. This means that for a distance A1 of 20 mm and a stitch length of 3 mm at the earliest after seven stitch forming processes and a corresponding feed path of $7\times3=21$ mm output signals are generated for the scanning and marking devices 109,113. The output signals cause the electromagnets 96,114 to be excited simultaneously and the plungers 103, 119 are pressed against the respective work ply W1, W2. In so doing, the wick material 104 present in the region of the plunger opening and wetted with the volatile ink is brought in contact with the work plies W1, W2 and creates on them a dark-colored mark visible for a limited time only. In order that the marks will form a sufficient dark-bright contrast to the surface of the work plies W1, W2 for the subsequent optical scanning, dark-colored ink can be used only for light colored and preferably unpatterned workpieces. If also dark or patterned workpieces are to be sewn, it is better to use a fluorescing ink, to irradiate the resulting marks with ultraviolet light for the purpose of scanning, and to use sensors which are sensitive to ultraviolet light.

With the turning on of the electromagnets 96, 114, the distributing valves 106, 121 are briefly switched to flow position, whereby a connection is established between the wick material 104 and the ink supply in the containers 108, 124, and the quantity of ink given off during marking is replenished. By varying the turn-on time of the switching magnets 107, 122, the degree of saturation of the wick material 104 can be controlled.

Simultaneously with the generation of the output signals for the scanning and marking devices 109, 113, a counting process for the pulses generated by the pulse generator 92 is started. In this manner, the scanning and marking devices 109, 113 in conjunction with the signal processing system 112 perform, besides the marking, also the function for which otherwise separate scanning devices would be needed. As the scanning and marking devices 109, 113 are actuated in the non-transport phase of the feeders 9, 10, whereas the pulse generator 92 generates counting pulses only during the transport phase, the pulse counting process always begins only after the marking processes are completed. It is thereby avoided that a different time stagger between the marking and the start of the pulse count caused by different rotational speeds of the sewing machine, can occur.

The pulse counting process takes place parallelly in two registers of the signal processing system 112. Now if both sensors 127, 128 recognize the two previously produced marks simultaneously, they also end the pulse counting process in the two registers simultaneously. Since an identical pulse sum is then contained in both registers, a comparison of the pulse sums carried out subsequently by the signal processing system 112 has the result that the two work plies W1, W2 have traveled an equally long transport path. In this case no control commands are supplied to the step motor 82, so that the adjustment of the setting device 81 remains unchanged.

Based on various factors such as different type of cloth of the upper and lower work plies W1, W2 of different surface constitution, different material thickness or different direction of the warp and weft threads, the two plies W1, W2 may have a different transport behavior, so that despite equal feed steps of the feeders 9, 10 the two plies W1, W2 are transported at different speed, owing to which a transport stagger results between them. In that case the sensors 127, 128 will recognize the marks at different times. Accordingly, also the pulse counting process will be ended at different times in the two registers, so that the register controlled by the sensor 127 or 128 actuated later receives a correspondingly larger pulse sum than the other register. The difference of the pulse sums is a measure of the transport stagger of the two work plies W1, W2 with respect to a transport path which corresponds to the distance A1.

Now from the difference of the pulse sums and the value of the amount of feed of the feeders 9, 10 stored via the input device 134 or respectively from the set value of the adjusting wheel 37, the signal processing system 112 calculates the correction required for compensating the transport stagger for the feed step size of the upper feeder 9. Because of the high operating speed of the signal processing system 112, it is practically immediately after determination of the difference of the pulse sums that a setting command corresponding to the correction value is supplied to the step motor 82, whereupon the step motor 82 adjusts the setting device 81 accordingly and thereby increase or reduces the step size of the upper feeder 9 relative to the setting of the lower feeder 10 left unchanged.

Since a new marking process is carried out at both work plies W1, W2, always after seven stitch forming processes, and since the optical scanning of the workbound marks ensures a feed synchronous, slip-free measured-value formation, there occurs during the entire sewing process a constant checking of the actual amount of advance of the work plies W1, W2 and if necessary a correspondingly frequent correction of the feed step size of the upper feeder 9, so that even at varying influence factors a practically stagger-free transport of both work plies W1, W2 is obtained.

The correction precision can be improved for example by shortening the distance A1, since in this way the marking devices 109,113 can be actuated after a smaller number of stitch forming processes and hence at equal workpiece length a greater number of marking, scanning and correction processes can be carried out. Another possibility for improving the correction precision is to generate two marks per work ply W1, W2 on a feed path corresponding to the distance A1. In this case, however, four instead of two registers must now be used for counting the pulses, which are in part operated simultaneously but with different starting and stopping times and are evaluated alternately.

The feed-synchronous and slip-free measured-value formation further permits at any time of a sewing process an exact determination of the length path traveled until then by the work plies W1, W2. For this purpose, there is needed an additional optical sensor, which is known and therefore not shown, whose scanning point lies laterally next to the stitch plate 130 and responds to the starting edge of the work plies W1, W2 running crosswise or obliquely to the feed direction V. With the aid of this sensor, at the beginning of a sewing process, an additional register of the signal processing system 112 is influenced to the effect of totaling all pulses generated by the pulse generator 92 during the sewing process. In the signal processing system 112, this pulse sum is multiplied by a feed factor whose magnitude depends on the stitch length adjusted at the adjusting wheel 37, and by a correction factor which takes into consideration the normally occurring slip between the feeders 9, 10 and the work plies W1, W2. The result of the multiplication forms the value of the distance traveled by the work plies W1, W2 up to this time. This value may be indicated, for example for manual seam length control in a display. Alternatively, switching processes on the sewing machine may be triggered by means of the exact distance measurement in connection with pre-selection counter after predetermined lengths of path.

The correction factor which takes into consideration the slip between the feeders 9, 10 and the work plies W1, W2 is determined as follows: From the distance A1, from the number of bar marks 90 on the strobe disk 91, and from the stitch length adjusted on the adjusting wheel 37, the signal processing system 112 calculated the number of pulses which would result in slip-free transport of the work plies W1,W2. Now this number of pulses is compared with the pulse sum, greater because of the slip, which is formed between the application of a mark on the lower work ply W2 and the recognition thereof by the sensor 128. The ratio between the calculated theoretical number of pulses and the recorded pulse sum then forms the correction factor for the aforesaid calculation of the distance actually traveled by the work plies W1, W2. As this correction factor cn be calculated anew after each marking and scanning process, a very accurate distance measurement can be obtained even for sewing parameters which change in the course of the sewing process and which influence the slip between the feeders 9, 10 and the work plies W1, W2.

Embodiment Example 2

When after the start of a sewing process the light bar 143 forming the scanning point of the front sensor 141, having passed the edge K of a jag Z, falls for the first time completely on the intermediate plate 131 and is fully reflected thereby, the sensor 141 brings about that the flip-flop 146 assumes the starting state 1. The signal state 1 on line 150 brings about that the AND gate 151 is opened for the pulses generated by pulse generator 92 and transformed into rectangular pulses in pulse former 153, so that they can be entered in register 156 and totaled there.

Now this pulse counting process must be terminated by the rear sensor 142 when the same edge K which had previously opened the AND gate 151 and has thus started the pulse counting process has, after completion of the path A2, run through under the scanning point of sensor 142 and the light bar 144 is completely reflected by the intermediate plate 131. Now in order that the jags Z present between the two light bars 143 and 144 at the time of response of the front sensor 141 will not prematurely interrupt the pulse counting process, the preselection counter 148 is set to the number which corresponds to the number of jags Z existing between the light bars 143 and 144. If, as in the example according to FIG. 6, there are four jags between the light bars 143 and 144, then the preselection counter 148 adjusted to the counting value four will give a control signal to the reset input of flip-flop 146 after four signals generated by the rear sensor 142, whereby this flip-flop is switched to the initial state O. The signal state O on line 150 brings about that the AND gate 151 is closed for the transmission of the pulses delivered by the pulse generator 92. Thus the pulse counting process in register 156 is ended.

Now the pulse sum in register 156 constitutes a measure of the speed of a work-bound optically scanned sign during passage through a fixed measurement path of length A2.

The same measuring process is carried out also with respect to the lower work ply W4, for which it is not necessary that the jag s Z of the two work plies W3, W4 run thrugh the scanning points of the front sensors 141, 160 triggering the counting processes in equal time. The summing of the pulses occurring in the separate registers 156,172 may alternatively take place with time stagger.

After completion of the two pulse counting processes the pulse sums are compared, any existing difference being a measure of a transport stagger of the work plies W3, W4. Now the signal processing system 158 calculates in the same manner as in embodiment example 1 the correction value needed for compensation of the transport stagger for the feed step size of the upper feeder 9 and supplied to the step motor 82 a setting command corresponding to this correction value for the readjustment of the setting device 81.

Embodiment Example 3

With the start of a sewing process, the light sources 185, 186 and 204 are turned on and the scanning points 190, 191, 207, 208 are thereby illuminated. The illumination of the lower scanning points 207, 208 occurs here with the aid of the light guides 205, 206, which are forked in the region of the scanning points and engage around the asociated light guides 203 of the line scan cameras 201, 202 from two sides. Simultaneously with the light sources also the line scan cameras 183, 184, 201, 202 are turned on. The further sequence is explained below at first for the upper work ply W5.

Of the surface section of ply W5 situated in the region of the CCD image sensor 181 the front line scan camera 183 takes a snapshot, in that the light reflected from the surface of ply W5 onto the CCD image sensor 181 generates in the photo-elements 187 a number of electrons corresponding to the luminosity, which are accumulated in each photo-element 187 to a closed charge packet. The optical information about the scanned object is thereby resolved into many individual picture elements and is electronically stored.

With the aid of internal clock cycles the stored charges are transferred into the parallel analog shift registers 188 and are thence supplied through additional transport cycles to an output amplifier (not shown) which delivers them as an analog video data stream. In the comparator 193 the analog video signals are transformed into binary video signals which represent black/white transitions above an adjustable reference voltage level, that is, all analog signal values which lie above the reference voltage level result in the binary signal 1 and all analog signal values which lie below the reference voltage level result in the binary signal O. The binary video signals are now entered in the shift register 196, which has exactly as many memory positions as the CCD image sensor 181 has photo-elements 187. In this manner, there is stored in the shift register 196 a binary signal profile which corresponds to the bright-dark contrast of the surface section of ply W5 picked up by the line scan camera 183. With appropriate adjustment of the reference voltage level, which must be adapted to the ground brightness of ply W5, there has thus been obtained a binary reproduction of the brightness structure of the scanned surface section, where the brightness structure formed from the position and mutual distance of the warp and weft threads of the fabric, thread irregularities and a possibly existing color pattern is unique like a fingerprint and thus constitutes an unambiguous characteristic of the work ply W5. Since with line scan cameras of this order of magnitude line frequencies up to 10 kHz can be obtained, sufficiently precise photographs can be produced also during the transport phase of the workpiece.

Simultaneously with the production of the instantaneous picture of a surface section by the line scan camera 183 a counting process for the pulses generated by the pulse generator 92 is started.

After a period of time which depends on the rate of advance of the plies W5, W6, and which corresponds at least to the shortest possible run-through time of the scanned surface section between the scanning points 190 and 191, the rear line scan camera 184 is turned on, which thereupon produces in the region of the surface section previously scanned by the front line scan camera 183 a first snapshot of the surface of ply W5. The resulting analog signal values are transformed into binary video signals in the same manner as for the front line scan camera 183 and are entered in the associated shift register 197. The binary signal profile stored in the shift register 197 in 1728 memory positions is now divided by the microprocessor 199 into three overlapping blocks of 1024 memory positions, corresponding to a division of the CCD image sensor 182 into three blocks C1, C2, C3 whose length corresponds exactly to the length B of the CCD image sensor 181.

The microprocessor 199 now performs successively an addition of the three signal profile blocks of the shift register 197 with the complementary value of the signal profile of the shift register 196, where for the binary addition of $1+1=10$ only the value "0" is retained. There is no transfer of "1" to the next storage position of the result register of the microprocessor 199. Now if in one of the three addition processes the value 1 results in all memory positions, coincidence prevails between the signal profile of the corresponding signal profile block of line scan camera 184 and the signal profile of line scan camera 183, that is, already in the first snapshot of the rear line scan camera 184 accidentally exactly that surface section of the work ply W5 was scanned which had previously been scanned by the front line scan camera 183.

With the dual formation of the signal profiles of one and the same surface sections, measurement results differing from each other may result already at a very small lateral displacement of the work ply of e.g. 6 μm, in that for example a dark spot standing out from the brighter surrounding, the size of a photo-element 187, is scanned in the first scanning process completely by a single photo element 187, and in the second scanning process by halves by two adjacent photoelement 187. In the first case there is formed at this point a single signal value 0, while in the second case two signal values 0 are formed. Because of this inaccuracy of measurement not to be ruled out, it will be desirable, therefore to establish the coincidence between two signal profiles already at a certain percentage of coinciding signal profile values.

By the measure of using for the rear scanning point 191 a line scan camera with a longer CCD image sensor 182 and dividing this CCD image sensor 182 into three overlapping blocks, the signal profiles of the rear line scan camera 184 can be compared with the signal profiles of the front line scan camera 183 also if and when the work ply W5 has run away laterally by a multiple of the width of the individual photo-elements 187 during the advance.

If coincidence has been found by the microprocessor 199 between the signal profiles of the front and of the rear line scan cameras 183 and 184, the counting process of the pulse generated by the pulse generator 92 is immediately stopped. The pulse sum now forms a measure of the speed of a work-bound optically scanned sign during passage through an established measurement distance of length A3.

If in the evaluation of the signal profile of the first snapshot of the rear line scan camera 184 no coincidence is found with the signal profile of the front line scan camera 183, additional snapshots are continuously made during the transport phase of the workpiece with the rear line scan camera 184 at highest possible line scan frequency, which photographs are close together or even overlap. To avoid delays in the evaluation of the signal profiles thus produced, it may be desirable to enter the block groups of signal profiles of the rear line scan camera 184 into their own registers, so that their evaluation can be carried out simultaneously.

The scanning and evaluating process described for the upper work ply W5 is carried out in the same manner by means of the line scan cameras 201, 202, also for the lower work ply W6, for which again a pulse sum is formed.

After termination of the two pulse counting processes, the pulse sums are compared, any existing difference being a measure of a transport stagger of the work plies W5, W6. The signal processing system 222 now calculates in the same manner as in the embodiment example 1 the correction value required for compensating the transport stagger for the feed step size of the upper feeder 9 and send to the step motor 82 a setting command corresponding to this correction value for the readjustment of the setting device.

While specific embodiments of the invention have been shown and described in detail to illustrate the application of the principles of the invention, it will be understood that the invention may be embodied otherwise without departing from such principles.

What is claimed is:

1. A method for determining the amount of advance of at least one work ply fed by a sewing machine which is driven by a main drive shaft using a sensor device which scans the ply at two points succeeding each other in a feed direction and a signal processing system connected to the sensor device, comprising connecting a pulse generator to the main shaft so as to generate a pulse in proportion to the speed of operation of said main shaft, delivering the pulse signals to the sensor device for evaluating the pulses generated between recognition of the sign of the two scanning points, and wherein for scanning there is used a sign situated at any desired point of the work ply, and comparing the pulse sum formed between the successive recognition of the sign with a desired pulse number corresponding to the stitch length and the distance between the scanning points.

2. A method according to claim 1, wherein there are two work plies and each of the plies are scanned by the sensor device and the measuring process is carried out on each work ply and wherein the pulse sum determined of one ply is directly compared with the pulse sum of the other ply to determine the amount of relative motion between the two plies.

3. A method according to claim 2, including forming a mark on the work ply during the sewing process before it moves past the sensor device and which is located so as to be scanned by said sensor device.

4. A method according to claim 1, including forming a sign on the work ply before the sewing process.

5. A method according to claim 4, wherein the mark formed comprises a scale having individual scale elements which are successively scanned by said sensor device.

6. A method according to claim 5, wherein the mark is formed by a pinked edge of the work ply.

7. A method according to claim 3, wherein the mark is formed with an arched portion and is wider than the second scanning point, the radius of the arc corresponding to the distance between the second scanning point and the axis of the needle.

8. A method according to claim 1, wherein at the first scanning point of a workpiece which serves as a sign, the sensor device produces an image of a plurality of electric signals by measuring values of structural criterian of the workpiece, for example the different luminosity of the workpiece, and including storing the values of the images, initating the start of the counting with the formation of the image, and at the second scanning point, the sensor device forms continuously images of successive area sections of the workpiece, and wherein the signal values of the images produced of the second scanning point are continuously compared with the stored signal values of the image of the first scanning point, and when the signal values coincide the pulse counting process is ended and the value of the actual amount of advance is determined.

9. A method of operating a sewing machine which has a thread needle reciprocating on one first side of a support surface onto which multiple plies of material are fed and which is adapted to cooperate with a bobbin on the opposite second side to form stitches of the material comprising feeding each ply by engaging the plies from respective first and second sides, scanning the material as it is being fed from at least one side, generating pulses in response to the speed of the needle and the feed, while the material is being scanned, comparing the sum of the pulses formed between successive scanning points with a desired pulse number corresponding to the stitch length and the distance between the scanning points.

10. A method according to claim 9, including changing the feed of materials on at least one side in response to the comparison made of the pulses.

11. A method according to claim 10, wherein the materials are scanned from each side and the feed of the materials of each side are compared and the speed of feeding thereof is varied in accordance therewith.

12. In a sewing machine having a thread needle reciprocating and swinging on one first side of a support surface under which multiple plies of materials are fed and which is adapted to cooperate with a bobbin on the opposite second side to form stitches in the materials, the improvement comprising, a first feed mechanism engageable with the materials on said first side to advance them in a feed direction, a second feed mechanism engageable with the materials on said second side to advance them in the feed direction, feed drive means connected to said thread needle and to said first feed mechanism and said second feed mechanism and including a stitch setting means for setting the swing of the needle and its reciprocation, and drive regulating means for regulating the drive of said first feed mechanism and said second feed mechanism sensor device including a scanner arranged at spaced locations along the feed of the materials, at least two spaced apart scanning locations, pulse generating means associated with said feed drive driven by said feed drive to generate a pulse signal in response to and in to the speed of said drive means and connected to said sensor device and being actuated by said sensor device at said scanning locations to evaluate the pulses generated between said scanning locations, said sensor device providing a comparison between desired pulse number corresponding to the stitch length and the distance between said scanning locations.

13. In a sewing machine according to claim 12, wherein said sensor device includes a marking device associated with one of said scanning means connected to said pulse generating means for starting the counting process, said marking device being located before the first scanning means.

14. A device according to claim 13, wherein said pulse generator includes a strobe disk and includes a rotatable part connected to the machine shaft having an additional single mark for a second pulse generator.

15. A device according to claim 13, wherein said sensor device comprises two scanning paints arranged at spaced locations along the feed path.

16. A device according to claim 15, wherein said marks are spaced on said materials at a closer spacing than the scanning point, and said scanning sensor device includes a scanning element associated with the rear scanning point having a register with a circuit connected to said output and serving for the summing of the pulses generated by the pulse generator of the signal processing system and including a pre-selection counter and a gate circuit connected with the counter for the pulses generated by the pulse generator.

17. A device according to claim 13, wherein said sensor device comprises for each work ply two line scanned cameras which in connection with illumination systems forms pairs of scanning points, a single processing system comprising for each line scan camera a comparator which transforms an analog video signal into a binary video signal and at least one shift register for each and including a microprocessor connected to said sensor device.

18. A device according to claim 17, wherein each line scan camera comprises a CCD image sensor composed of a plurality of photo-elements arranged in a row, said CCD image sensor of the line scan camera arranged at the trailing end in respect to the feed direction and being wider than the image sensors of the line scan cameras, which are arranged further forward in the feed direction, and including photo-elements of said CCD image sensors of the rear line scan cameras which are combined circuit-wise to form several crossing blocks whose width corresponds to the width of the CCD image sensors of the associated front line scan cameras and wherein the signal values of each block can be compared with the signal value of the CCD image sensor of the associated front line scan camera.

19. A device according to claim 18, wherein for simultaneous comparison of the signal values of the photo-elements combined to the blocks with the signal values of the CCD image sensor of the associated front line scan camera, the signal processing system comprises a corresponding number of shift registers.

* * * * *